US011263870B2

(12) United States Patent
Hsu

(10) Patent No.: US 11,263,870 B2
(45) Date of Patent: Mar. 1, 2022

(54) WINNING GAME SYSTEM OFFERING MULTIPLE WINNINGS SIMULTANEOUSLY

(71) Applicant: Tien-Shu Hsu, Taichung (TW)

(72) Inventor: Tien-Shu Hsu, Taichung (TW)

( * ) Notice: Subject to any disclaimer, the term of this patent is extended or adjusted under 35 U.S.C. 154(b) by 210 days.

(21) Appl. No.: 16/552,012

(22) Filed: Aug. 27, 2019

(65) Prior Publication Data

US 2021/0065510 A1 Mar. 4, 2021

(51) Int. Cl.
*G07F 17/32* (2006.01)

(52) U.S. Cl.
CPC ..... *G07F 17/3267* (2013.01); *G07F 17/3209* (2013.01); *G07F 17/3213* (2013.01); *G07F 17/3244* (2013.01)

(58) Field of Classification Search
USPC ..... 463/16
See application file for complete search history.

(56) References Cited

U.S. PATENT DOCUMENTS 7,614,948 B2 * 11/2009 Saffari ..... G07F 17/3258 463/17
7,959,507 B2 * 6/2011 Cannon ..... G07F 17/34 463/21
10,176,670 B2 1/2019 Hsu
10,803,707 B2 * 10/2020 Elias ..... G07F 17/329
2005/0059467 A1 * 3/2005 Saffari ..... G07F 17/3258 463/19
2005/0059470 A1 * 3/2005 Cannon ..... G07F 17/329 463/19
2008/0300055 A1 * 12/2008 Lutnick ..... G07F 17/32 463/39
2010/0041459 A1 * 2/2010 Saffari ..... A63F 13/00 463/19
2014/0066161 A1 * 3/2014 Bigelow, Jr ..... G07F 17/3267 463/17
2014/0106839 A1 * 4/2014 Bigelow, Jr ..... G07F 17/3286 463/16
2018/0018014 A1 * 1/2018 Lutnick ..... G07F 17/32
2019/0180555 A1 * 6/2019 Elias ..... G07F 17/3225

* cited by examiner

*Primary Examiner* — Pierre E Elisca
(74) *Attorney, Agent, or Firm* — Muncy, Geissler, Olds & Lowe, P.C.

(57) ABSTRACT

A user interface of the invention includes an operation input interface including multiple selection buttons for a player to conduct a winning game, and an information output interface including winning balls positioned corresponding to the selection buttons. The winning balls respectively comprise a pattern which is hidden. The winning balls are respectively associated with at least one of multiple winning prizes. After a winning game starts, the winning balls and the selection buttons are provided on the information output interface and the operation input interface. The pattern of the winning prize having the position corresponding to the selection button selected by the player is displayed, and at least one associated winning prize is triggered according to the selected selection button. When the triggered times of the winning prize has reached a threshold, the player wins the winning prize of which the triggered times has reached the threshold.

14 Claims, 10 Drawing Sheets

WINNING GAME SYSTEM OFFERING MULTIPLE WINNINGS SIMULTANEOUSLY

FIELD OF THE INVENTION

The present invention relates to a winning game, and particularly to an operating system of a winning game.

BACKGROUND OF THE INVENTION

A convention winning game is a small game independent from a game system. For example, the U.S. Pat. No. 10,176,670 discloses a prize money game system provided with a user interface comprising a plurality of selection buttons, and a player is allowed to select the plurality of selection buttons as desired. The plurality of selection buttons, after having been selected by the user, may either be options that can be further selected or options that end the prize money game. The above operation is intuitive and can be performed without needing to learn rules in advance, and forms a game means similar to a lottery with uncertain outcomes, allowing a player to conduct a prize money game and to obtain a winning.

In a winning game as the prize money game described above, the source of the winning can be selected from a plurality of winning prizes. Although a player can acquire additional multiples by a selected option and thus increase the winning, the player can acquire one winning prize at a time. As a result, the imagination boundaries of user expectation in regard to obtaining more prize money from multiple winnings are somewhat limited.

SUMMARY OF THE INVENTION

Therefore, it is a primary object of the present invention to provide a winning game system, which fulfills the expectation of a user for acquiring multiple winnings and thus obtaining more prize money, so as to boost the interest in playing.

On the basis of the above object, the present invention provides a winning game system offering multiple simultaneously acquirable winnings for a player to conduct a winning game and to win at least one of a plurality of winning prizes from at least one winning pool database. The winning system includes an operation processing unit and a user interface. The operation processing unit is connected to the at least one winning pool database, and obtains a value and a corresponding name of each of the plurality of winning prizes. The user interface is connected to the operation processing unit, and includes an operation input interface and an information output interface. The operation input interface includes a plurality selection buttons for the player to conduct the winning game. The information output interface includes a plurality of winning balls which are positioned corresponding to the plurality of selection buttons, and the plurality of winning balls respectively comprise a pattern which is hidden. Further, the operation processing unit comprises a game start determination procedure, an accumulation procedure, a game end determination procedure and a winning payout procedure, and performs the following steps:

step a: a game start, defining the plurality of winning balls respectively associated with at least one of the plurality of the winning prizes in accordance with the plurality of winning balls with different patterns, when the operation processing unit determines that the winning game is started according to the game start determination procedure;

step b: an interface activation, displaying the plurality of winning balls with the patterns which are hidden on the information output interface individually, and activating the plurality of selection buttons on the operation input interface;

step c: a selection, controlling the information output interface to display one of the patterns of the plurality of winning balls which is positioned corresponding to the selection button after the player selects one of the plurality of the selection buttons;

step d: an accumulation, triggering at least one of the plurality of winning prizes associated therewith according to the winning ball which is selected by the operation processing unit, and accumulating a plurality of triggered times of the plurality of winning prizes respectively through the accumulation procedure;

step e: a determination of whether a game ends; determining whether the winning game is satisfied with an end condition through the game end determination procedure, wherein the end condition for ending the winning game is that the through the game end determination procedure of at least one of the plurality of winning have reached a threshold;

step f: a repeated selection, repeating step c, step d and step e until the end condition for ending the winning game is satisfied;

step g: a winning payout, allowing the player to award the plurality of winning prizes of which the triggered times reached the threshold through the winning payout procedure, after the winning game has ended.

Accordingly, the operation processing unit of the present invention defines, according to different patterns of the plurality of winning balls, that the plurality of winning balls are respectively associated with at least one of the plurality of winning prizes. When the player selects the selection button and triggers multiple associated winning prizes among the plurality of winning prizes, it is possible that the numbers of times of triggering the multiple associated winning prizes among the plurality of winning prizes concurrently reach the threshold, enabling the player to simultaneously win the winning prizes having reached the threshold, thus allowing the player to expect multiple wins so as to obtain more winnings.

DETAILED DESCRIPTION OF THE PREFERRED EMBODIMENTS

Details and technical contents of the present invention are further described by way of embodiments below. It should be understood that, the embodiments are illustrative and are not to be construed as limitations to the present invention.

Figure 1:
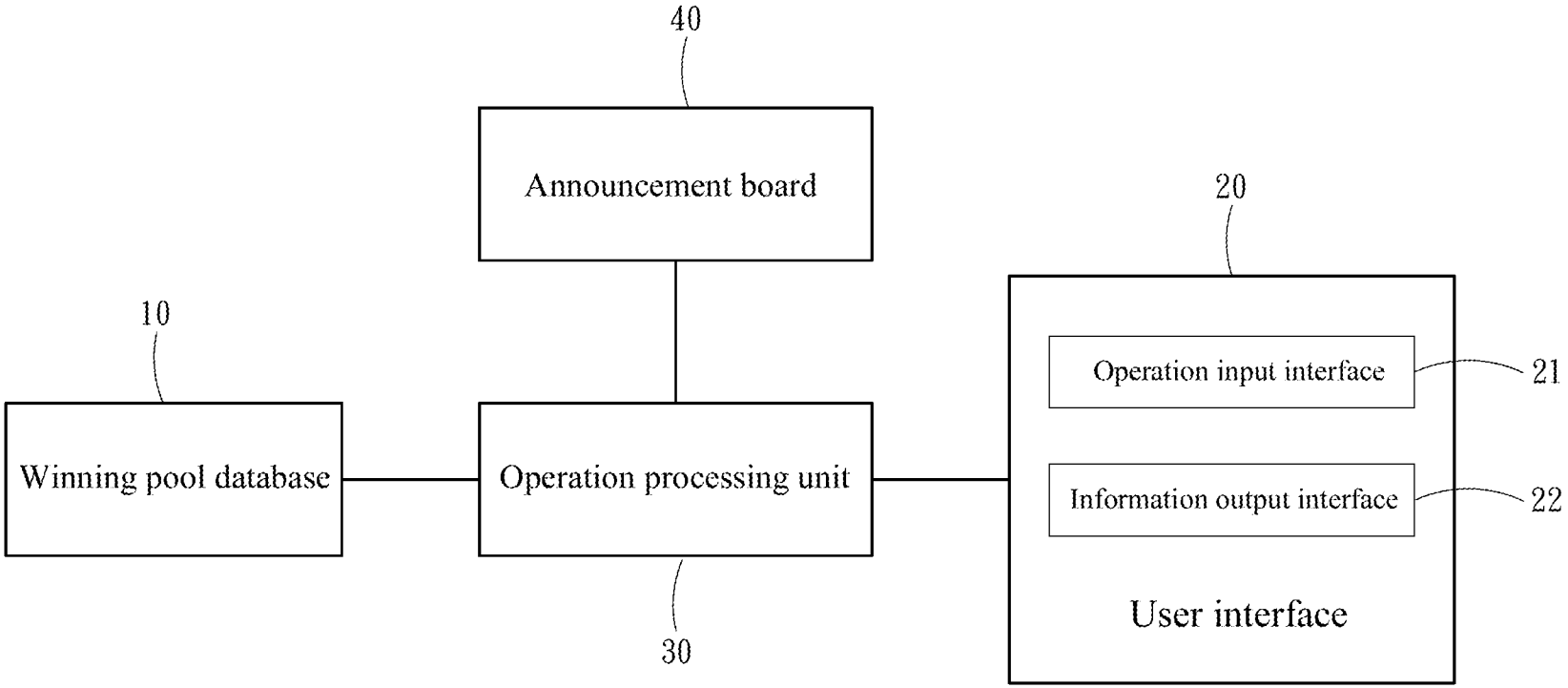
FIG. 1 is a structural diagram of a winning game system of the present invention.
Figure 2:
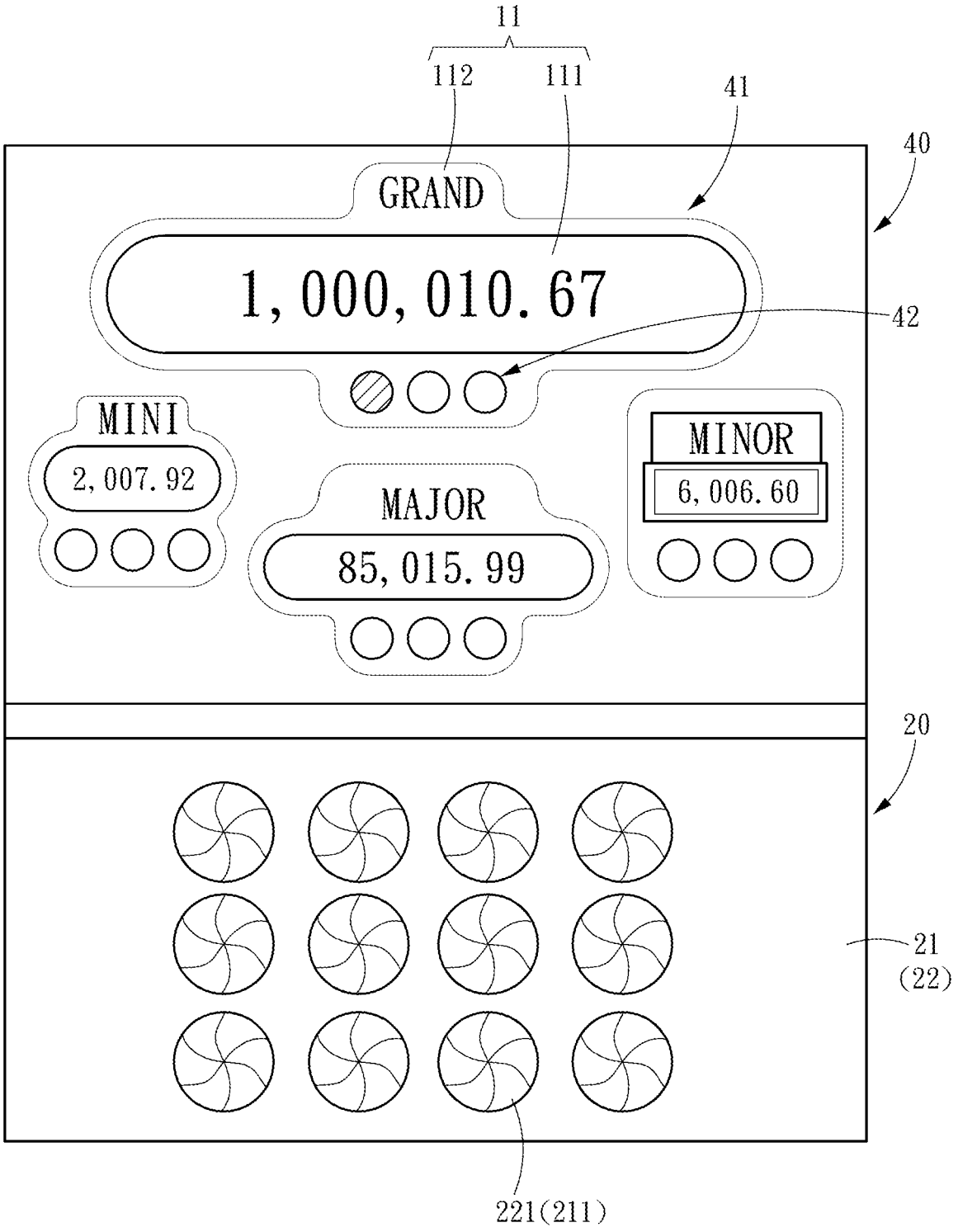
FIG. 2 is a schematic diagram of an image of a user interface and an announcement board of the present invention.
Figure 3:
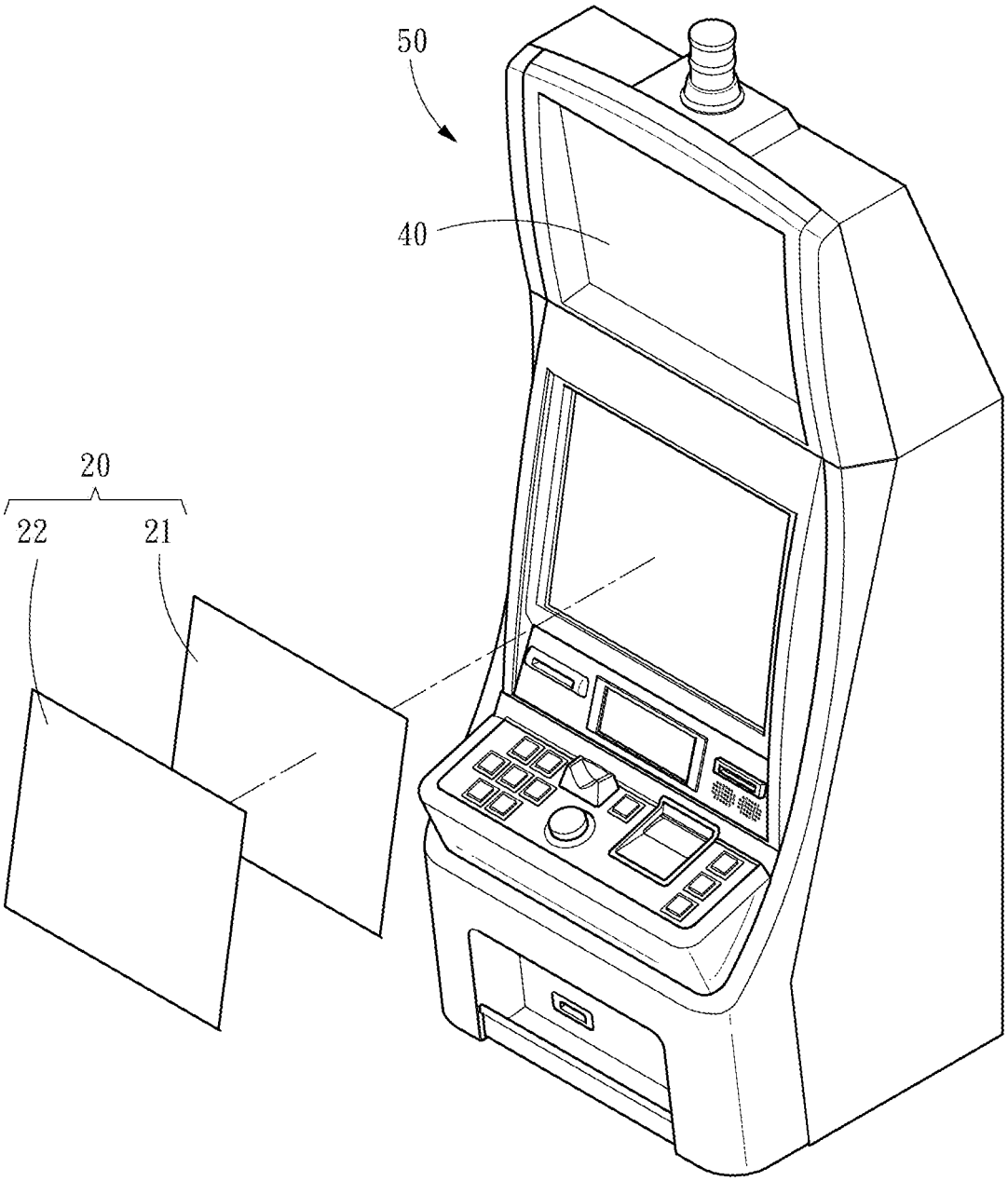
FIG. 3 is a schematic diagram of a machine of a winning game system of the present invention.

Referring to FIGS. 1, 2 and 3, the present invention is a winning game system offering multiple winnings simultaneously, for a player to conduct a winning game and then to win at least one of a plurality of winning prizes 11 from at least one winning pool database 10. The at least one winning pool database 10 could be a database merely connected to one game machine and hence accumulated winnings, or a database connected to multiple game machines and hence accumulated winnings together. As shown in FIG. 1, only one winning pool database 10 is depicted to be represented. The winning game system includes an operation processing unit 30 and a user interface 20. The operation processing unit 30 is connected to the winning pool database 10, and respectively obtains a value 111 and a corresponding name 112 of each of the plurality of winning prizes 11. The corresponding name 112 of the plurality of winning prizes 11 can be any of four names "GRAND", "MAJOR", "MINOR" and "MINI". To enable a player clearly knowing a current game status, the present invention further includes an announcement board 40 which is connected to the operation processing unit 30. The announcement board 40 comprises a plurality of display regions 41 which display the value 111 and the corresponding name 112 of each of the plurality of winning prizes 11 one-to-one.

The user interface 20 is connected to the operation processing unit 30, and includes an operation input interface 21 and an information output interface 22. The operation input interface 21 includes a plurality of selection buttons 211 which are freely selected by the player to conduct the winning game. The information output interface 22 includes a plurality of winning balls 221 which are positioned corresponding to the plurality of selection buttons 211. The plurality of winning balls 221 respectively comprises a pattern which is hidden. In practice, as shown in FIG. 3, the present invention is provided for implementing on a game machine 50, and the user interface 20 is provided as a touch screen which is simultaneously used as the operation input interface 21 and the information output interface 22, so as to provide both functions of displaying and inputting the operation. Hereby, the plurality of selection buttons 211 overlap with the plurality of winning balls 221, and only the winning balls 221 are displayed.

Figure 4:
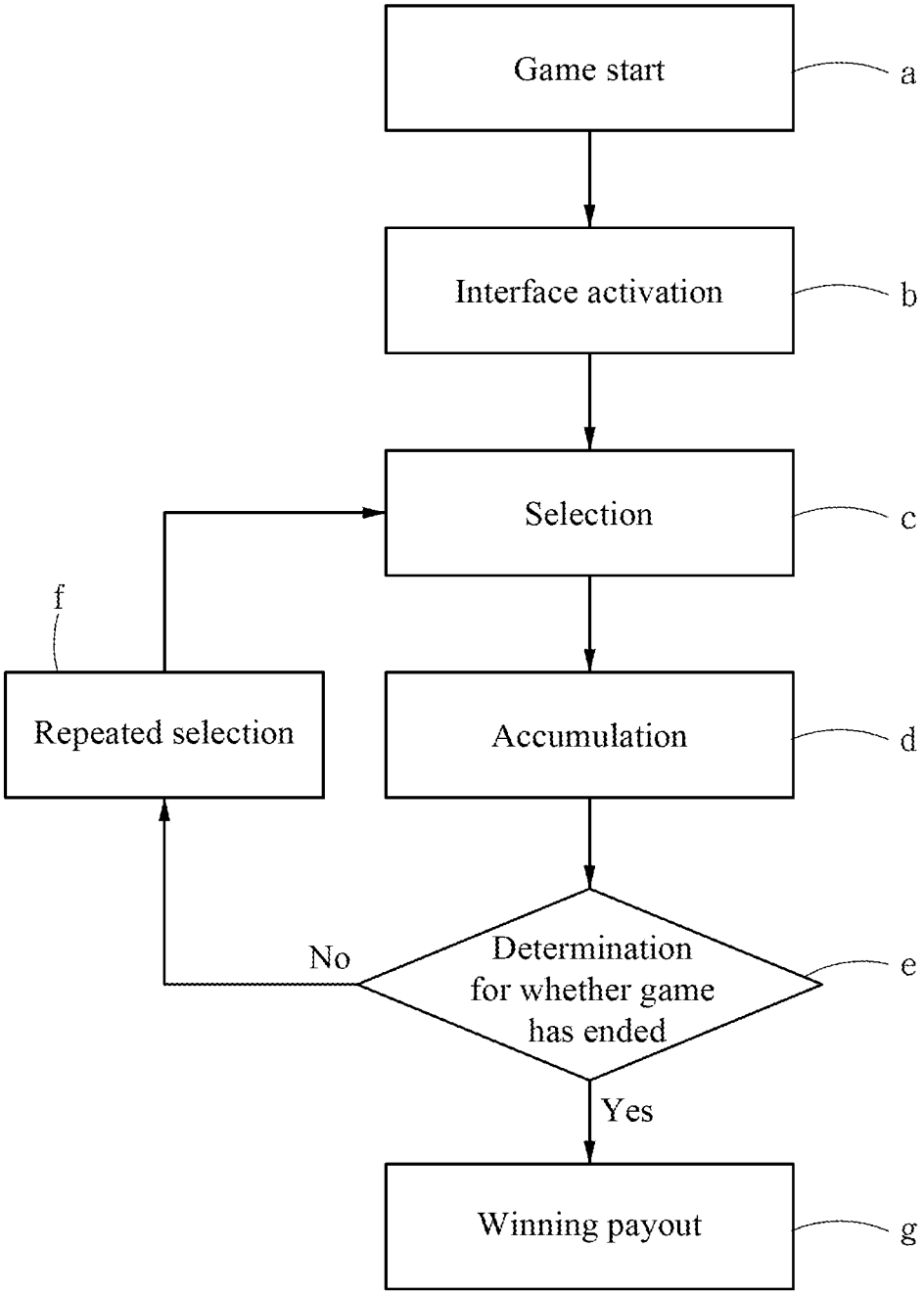
FIG. 4 is a flowchart of an operation of the winning game system of the present invention.

Referring to FIG. 4, the operation processing unit 30 comprises a game start determination procedure, an accumulation procedure, a game end determination procedure and a winning payout procedure. Then, the operation processing unit 30 performs the following steps a-g, which are associated details given below.

Figure 5:
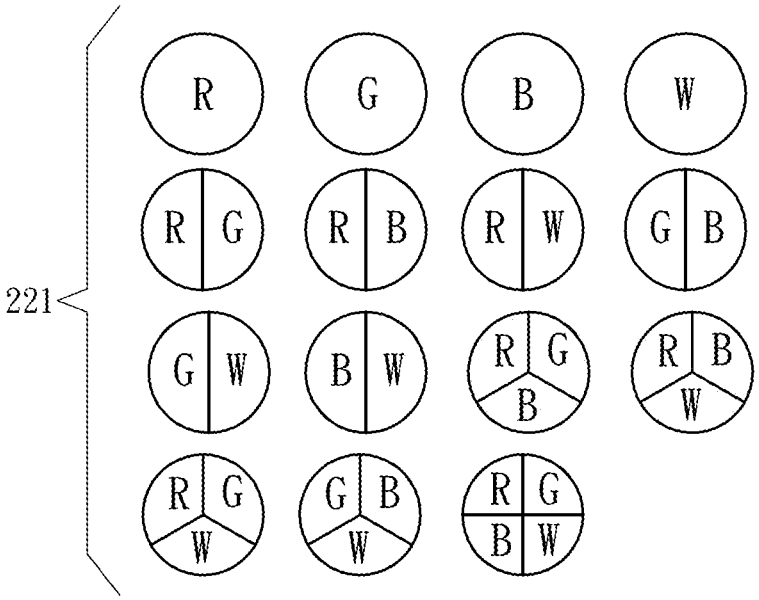
FIG. 5 is a schematic diagram of winning balls comprising different patterns of the present invention.

In step a: a game start, defining the plurality of winning balls 221 to be respectively associated with at least one of the plurality of winning prizes 11 in accordance with the plurality of winning balls 221 with different patterns, when the operation processing unit 30 determines that the winning game is started according to the game start determination procedure. For example, FIG. 5 shows one implementation of the patterns of the plurality of winning balls 221 which are hidden. Each of the plurality of winning balls 221 comprises at least one symbol which is selected from R, G, B and W, wherein R, G, B and W respectively represent "GRAND", "MAJOR", "MINOR" and "MINI". If one of the plurality of the winning balls 221 only comprises R, it represents that the winning ball 221 is associated with "GRAND" of the plurality of winning prizes 11; if one of the plurality of winning balls 221 comprises R and G, it represents that the winning ball 221 is associated with "GRAND" and "MAJOR" of the plurality of winning prizes 11; if one of the plurality of winning balls 221 comprises R, G, B and W, it represents that the winning balls 221 is associated with "GRAND", "MAJOR", "MINOR" and "MINI" of the plurality of winning prizes 11; and so forth.

In step b: an interface activation, displaying the plurality of winning balls 221 with the patterns which are hidden on the information output interface 22 individually, and activating the plurality of selection buttons 211 on the operation input interface 21 which are all performed by the operation processing unit 30, as shown in FIG. 2.

Figure 6A:
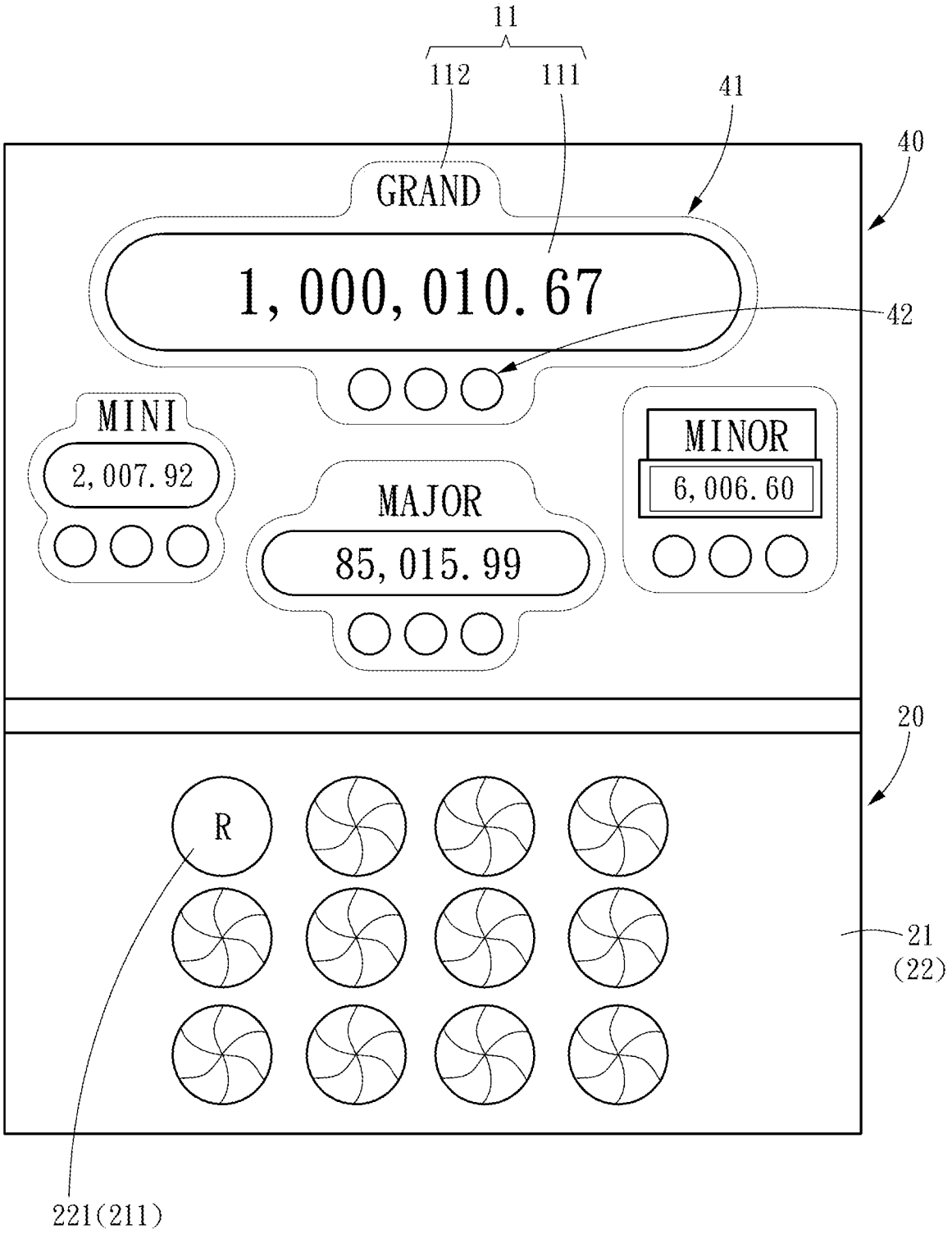
FIGS. 6A-D are schematic diagram of images according to an embodiment of the present invention.

In step c: a selection, referring to FIG. 6A, controlling the information output interface 22 by the operation processing unit 30 after the player selects one of the selection buttons 211, to display one of the patterns of the winning balls 221 which is positioned corresponding to the selection button 211 that is selected. Herein the player selects the selection button 211 which is corresponding to the pattern of the winning ball 221 with the symbol R.

Figure 6B:
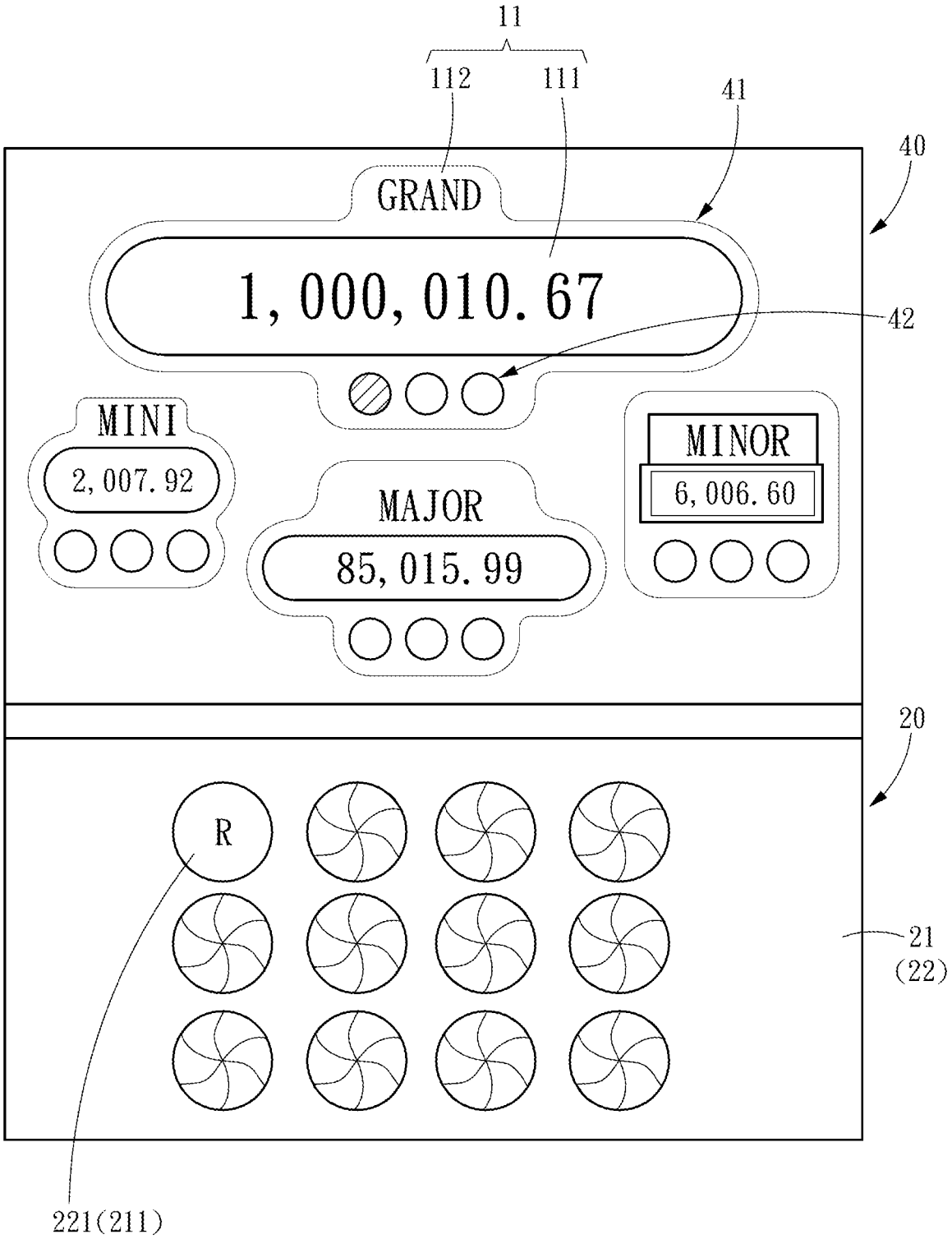

Further referring to FIG. 6B, in step d: an accumulation, triggering at least one of the plurality of winning prizes 11 associated therewith according to the winning ball 221 which is selected by the operation processing unit 30, and accumulating a plurality of triggered times of the winning prizes 11 respectively through the accumulation procedure. Then, the winning ball 221 is associated with "GRAND" of the winning prizes 11 since the pattern of the winning ball 221 only comprises the symbol R. Each of the plurality of display regions 41 further respectively includes a display field 42 which displays the triggered times of the winning prizes 11 correspondingly. That is, the accumulation procedure notifies the operation processing unit 30 controlling the announcement board 40 to display the triggered times of the winning prizes 11 in the display field 42 of the plurality of display regions 41. As shown in FIG. 6B, the display field 42, where is corresponding to "GRAND", appears one ball (represented by a shaded ball in FIG. 6B), so as to indicate that the winning prize 11 has been triggered once.

In step e: a determination for whether the game ends, determining whether the winning game is satisfied with an end condition through the game end determination procedure performed by the operation processing unit 30, wherein the end condition for ending the winning game is that the triggered times of at least one of the plurality of winning prizes 11 have been reached a threshold. As shown in FIG. 6B, the display field 42 comprises three blocks, which means that the plurality of winning prizes 11 has to be triggered three times so as to reach the threshold. At this point, the plurality of winning prizes 11 is only triggered once, which means that the game has not ended.

In step f: a repeated selection, performing step c, step d and step e repeatedly until the end condition for ending the winning game is satisfied.

Figure 6C:
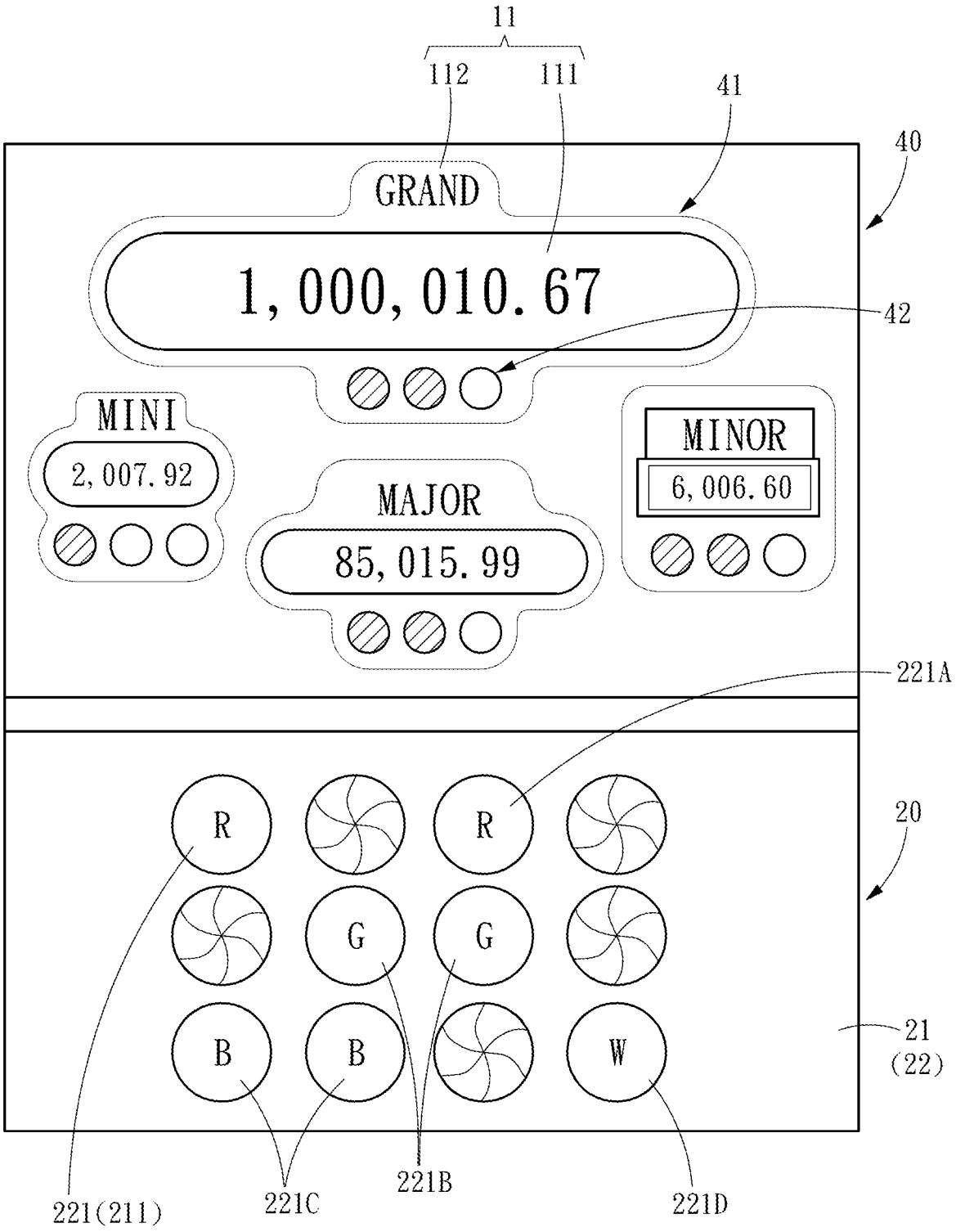

In one embodiment, if the player selects another selection buttons 211, another winning ball 221 with different pattern would be obtained. As shown in FIG. 6C, it obtains a winning ball 221A which is associated with "GRAND" of the plurality of winning prizes 11, two winning balls 221B which are associated with "MAJOR" of the plurality of winning prizes 11, two winning balls 221C which are associated with "MINOR" of the plurality of winning prizes 11, and one winning ball 221D which is associated with "MINI" of the plurality of winning prizes 11. Herein, "GRAND", "MAJOR" and "MINOR" of the plurality of winning prizes 11 have been triggered twice respectively.

Figure 6D:
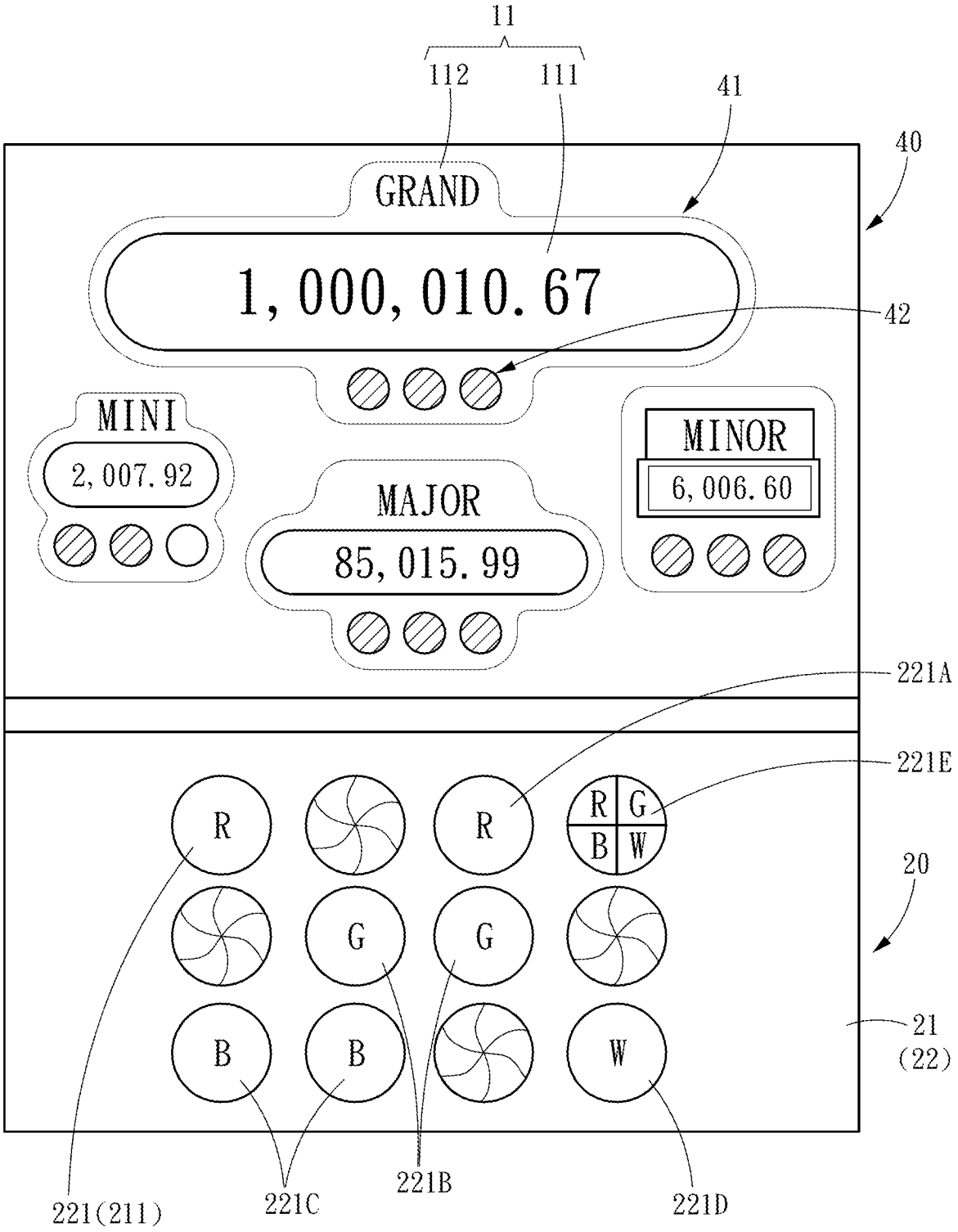

Further referring to FIG. 6D, when the player selects the selection button 211 and obtains a winning ball 221E which is associated with "GRAND", "MAJOR", "MINOR" and "MINI" of the plurality of winning prizes 11, the triggered times of "GRAND", "MAJOR", and "MINOR" have reached the threshold at this point. It can be determined hereby that the end condition for ending the winning game is satisfied.

In step g: a winning payout, allowing the player to award the plurality of winning prizes 11 of which the triggered times reached the threshold through the winning payout procedure by the operation processing unit 30, after the winning game has ended. That is, the player won multiple winnings and acquired the plurality of winning prizes 11 simultaneously, considering "GRAND", "MAJOR" and "MINOR" all have been reached the threshold.

Further, to avoid cracking behaviors of hackers, such as obtaining all of the patterns of the plurality of winning balls 221 by using a decoding program beforehand. When the selection button 211 of the present invention is selected by the player, the operation processing unit 30 then randomly selects any one of the plurality of winning balls 221 to be a position-associated winning ball.

In addition, to meet requirements of business promotions and profit management, a probability of the plurality of winning balls 221, which is randomly selected by the operation processing unit 30 and associated with at least two of the plurality of winning prizes 11, has a change according to a remaining number of the plurality of selection buttons 211 that are not selected. To increase business profit, the change of the probability is set to be decreased, in order to reduce the probability of multiple winnings won by the player. In contrast, for promotion purpose, the change of the probability is set to be increased, in order to increase the probability of multiple winnings won by the player.

Figure 7:
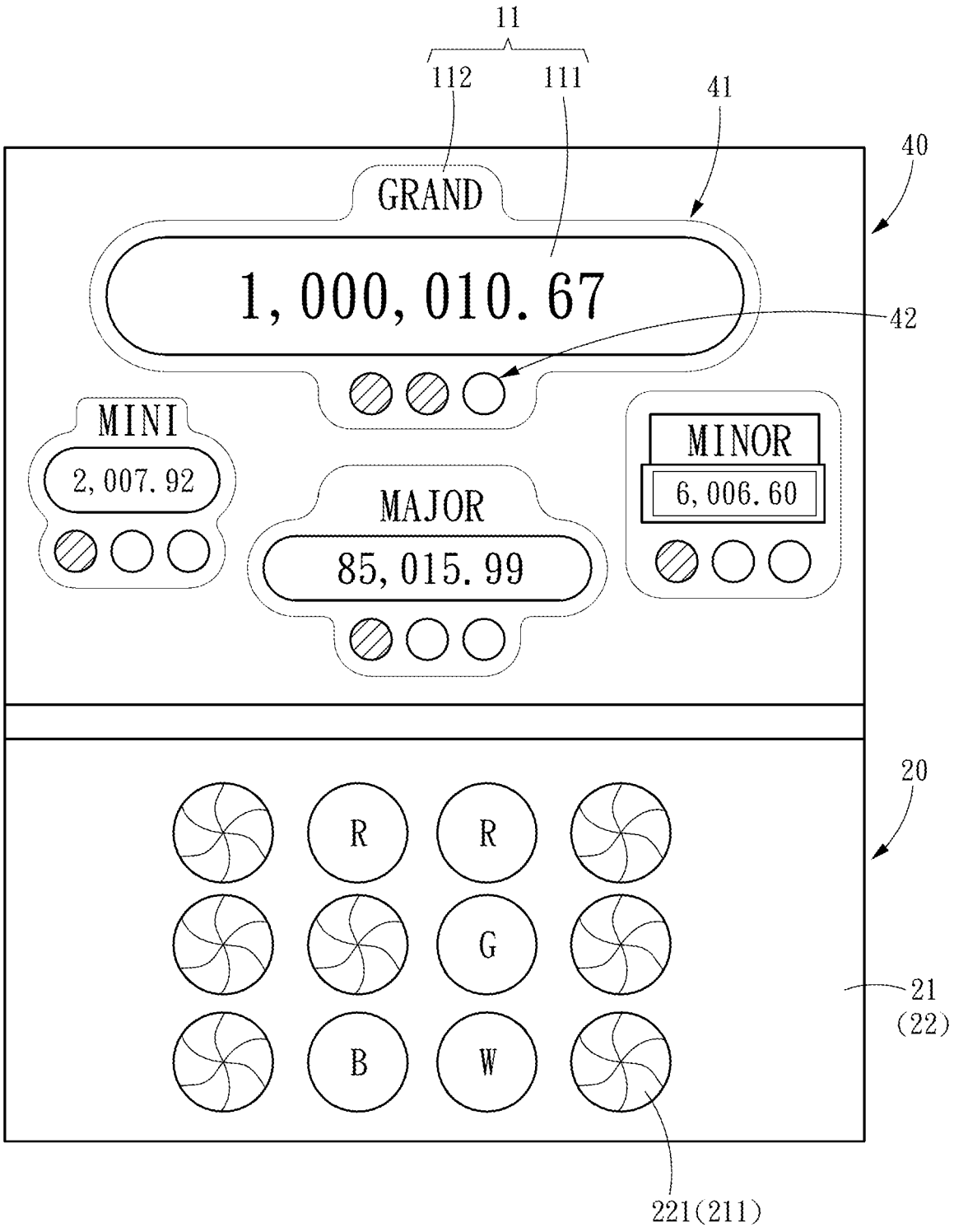
FIG. 7 is a schematic diagram of an image according to another embodiment of the present invention.

As shown in FIG. 7, only before at least one of the pluralities of winning prizes 11 being triggered one more time to reach the threshold, the operation processing unit 30 then incorporates the winning balls 221 which is associated with at least two of the winning prizes 11 into the scope of random selection. The player is paying attention on the winning game when the plurality of winning prizes 11 are about to be required. Thus, if the player selects the plurality of winning balls 221 associated with the at least two of the plurality of winning prizes 11 at the time, the impression of multiple winnings can be reinforced for the player, whereby boosting the willingness of the player in continuing the game.

Moreover, to meet business requirements, the plurality of winning balls 221 can be divided into a first group and a second group according to the associated number of the plurality of winning prizes 11, wherein the plurality of winning balls 221 in the first group are associated to one of the plurality of winning prizes 11, the plurality of winning balls 221 in the second group are associated with at least two of the plurality of winning prizes 11, and the operation processing unit 30 sets the probability for randomly selecting the plurality of winning balls 221 in the first group is greater than the probability for randomly selecting the plurality of winning balls 221 in the second group. At this point, times for the player to select the plurality of selection buttons 211 can be increased.

Besides, to meet requirements of business promotions and profit management, the operation processing unit 30 sets the probability for randomly selecting the plurality of winning balls 221 in the second group comprises a change according to a total of triggered times of the plurality of winning prizes 11. To increase business profit, the change of the probability is set to be decreased, in order to reduce the probability of multiple winnings won by the player. In contrast, for promotion purpose, the change of the probability is set to be increased, in order to increase the probability of multiple winnings won by the player. Moreover, to increase times of selecting the plurality of selection buttons 211 for the player, in the plurality of winning balls 221 of the first group, the operation processing unit 30 sets a greater selection probability for the plurality of winning balls 221 associated with the plurality of winning prizes 11 is not triggered.

In conclusion, the present invention at least includes the following features.

1. The operation processing unit defines the plurality of winning balls which are respectively associated with at least one of the plurality of winning prizes, according to the patterns of the plurality of winning balls, such that more than one of the winning prizes are triggered after the player selects the selection buttons. That is, it is possible that more than one of the plurality of winning prizes would together meet the triggered times of the threshold in the meantime, enabling the player to simultaneously win the plurality of winning prizes which corresponds to the threshold been reached, thus offering the player with the expectation and hope for multiple winning and acquire more winnings.

2. The operation processing unit can eliminate the cheating behaviors of the hacker cracking by randomly selecting any one of the plurality of winning balls. Further, the present invention can also meet different business requirements by changing the probability of the winning ball associated with different prize winnings.

3. The winning balls associated with at least two of the winning prizes are incorporated into the scope of random selection, before at least one of the pluralities of winning prizes being triggered one more time to reach the threshold. Accordingly, considering the attention of the player would highly focus thereon, appearing the winning ball associated with at least two of the winning prizes would deepen that impression that he will win multiple winnings, and thus boosting the willingness of the player in continuing the game.

4. By dividing the plurality of winning balls into a first group and a second group according to the associated number of the plurality of winning prizes, and by controlling the probabilities of different groups, the probability of multiple winnings won by the player can be readily controlled, thus meeting business requirements.

What is claimed is:

1. A winning game system offering multiple winnings simultaneously, for a player to conduct a winning game and to win at least one of a plurality of winning prizes from at least one winning pool database, the winning game system comprising:

an operation processor, connected to the at least one winning pool database to retrieve a value and a corresponding name of each of the plurality of winning prizes; and a user interface, connected to the operation processor, and including an operation input interface and an information output interface, the operation input interface comprising a plurality of selection buttons for the player to conduct the winning game, the information output interface comprising a plurality of winning balls which are positioned corresponding to the plurality of selection buttons, and the plurality of winning balls respectively comprising a pattern which is hidden;

wherein the operation processor performs following steps:

step a: a determination for whether a game started, commanding a game start determination module to determine whether the winning game is started, retrieving the pattern of each of the plurality of winning balls from the information output interface, and respectively associating the plurality of winning balls with at least one of the plurality of winning prizes in accordance with the plurality of winning balls with different patterns;

step b: an interface activation, controlling the information output interface to display the plurality of winning balls but hide the patterns thereof, and activating the plurality of selection buttons on the operation input interface;

step c: a selection, controlling the information output interface to display one of the patterns of the plurality of winning balls which is positioned corresponding to the selection button, after one of the plurality of selection buttons is selected;

step d: an accumulation, triggering at least one of the plurality of winning prizes associated with the one of the plurality of winning balls, and commanding an accumulation module to accumulate triggered times that each of the plurality of winning prizes is triggered;

step e: a determination for whether a game ends, commanding a game end determination module to determine whether the winning game is satisfied with an end condition, wherein the end condition for ending the winning game is that the triggered times of at least one of the plurality of winning prizes have reached a threshold;

step f: a repeated selection, repeating step c, step d and step e until the end condition for ending the winning game is satisfied; and step g: a winning payout, commanding a winning payout module to award the plurality of winning prizes of which the triggered times reached the threshold through a winning payout module after the winning game has ended.

2. The winning game system of claim 1, wherein the winning game system further comprises an announcement board connected to the operation processor, and the announcement board comprises a plurality of display regions, which display the value and the corresponding name of each of the plurality of winning prizes one-to-one.

3. The winning game system of claim 2, wherein each of the plurality of display regions further comprises a display field respectively, and the display field displays the triggered times of the plurality of winning prizes correspondingly.

4. The winning game system of claim 1, wherein when one of the plurality of selection buttons is selected by the player, the operation processor randomly selects any one of the plurality of winning balls to be a position-associated winning ball.

5. The winning game system of claim 4, wherein a probability of the plurality of winning balls, which is randomly selected by the operation processor and associated with at least two of the plurality of winning prizes, comprises a change according to a remaining number of the plurality of selection buttons that are not selected.

6. The winning game system of claim 5, wherein the change of the probability is set to be decrease.

7. The winning game system of claim 5, wherein the change of the probability is set to be increase.

8. The winning game system of claim 4, wherein only before at least one of the plurality of winning prizes is triggered one more time to reach the threshold, the operation processor incorporates the plurality of winning balls associated with at least two of the plurality of winning prizes into a scope of random selection.

9. The winning game system of claim 1, wherein the user interface is provided as a touch screen.

10. The winning game system of claim 4, wherein the plurality of winning balls are divided into a first group and a second group according to the number of the plurality of winning prizes, the plurality of winning balls in the first group are associated with one of the plurality of winning prizes, and the plurality of winning balls in the second group are associated with at least two of the plurality of winning prizes, and wherein the operation processor sets a probability for randomly selecting the plurality of winning balls in the first group is greater than randomly selecting the plurality of winning balls in the second group.

11. The winning game system of claim 10, wherein the operation processor sets the probability for randomly selecting the plurality of winning balls in the second group comprises a change according to a total of triggered times of the plurality of winning prizes.

12. The winning game system of claim 11, wherein the change of the probability is set to be decrease.

13. The winning game system of claim 11, wherein the change of the probability is set to be increase.

14. The winning game system of claim 11, wherein in the plurality of winning balls of the first group, the operation processor sets a greater selection probability for the plurality of winning balls associated with the plurality of winning prizes is not triggered.

* * * * *